US005620134A

United States Patent [19]

Gulliver

[11] Patent Number: 5,620,134

[45] Date of Patent: Apr. 15, 1997

[54] CLOSABLE CARTON

[75] Inventor: Richard E. Gulliver, Tuscaloosa, Ala.

[73] Assignee: Gulf States Paper Corporation, Tuscaloosa, Ala.

[21] Appl. No.: 553,221

[22] Filed: Nov. 7, 1995

[51] Int. Cl.[6] ..... B65D 5/462

[52] U.S. Cl. ..... 229/117.14; 53/376.4; 53/491; 229/114; 229/128; 229/138; 229/911

[58] Field of Search ..... 229/114, 117, 229/14, 117.15, 128, 138, 911; 53/376.4, 378.3, 491

[56] References Cited

U.S. PATENT DOCUMENTS

| | | | |
|---|---|---|---|
| 567,649 | 9/1896 | Lanzit . | |
| 889,048 | 5/1908 | Rike . | |
| 925,578 | 6/1909 | Haas | 229/138 |
| 1,367,356 | 2/1921 | Cranshaw . | |
| 2,305,365 | 12/1942 | Wentz | 229/138 |
| 2,336,655 | 12/1943 | Tobey et al. . | |
| 2,355,730 | 8/1944 | Inman . | |
| 2,959,337 | 11/1960 | Crane, Jr. | 229/911 |
| 3,166,235 | 1/1965 | Schroeder | 229/117.14 |
| 3,722,782 | 3/1973 | Collie | 229/117.14 |
| 3,927,824 | 12/1975 | Razziano | 229/117.14 |
| 4,307,834 | 12/1981 | Roccaforte | 229/114 |
| 4,747,536 | 5/1988 | Wischusen, III . | |
| 4,981,254 | 1/1991 | Depper | 229/117.14 |
| 5,413,273 | 5/1995 | Money | 229/138 |
| 5,458,270 | 10/1995 | Tsao . | |

*Primary Examiner*—Gary E. Elkins
*Attorney, Agent, or Firm*—Cushman Darby & Cushman Intellectual Property Group of Pillsbury Madison & Sutro LLP

[57] ABSTRACT

A carton includes a bottom wall panel, four side wall panels, each of the side wall panels being integrally connected along a fold line to the bottom wall panel thereby defining first and second pairs of opposite side wall panels. Corner portions integrally connect adjacent side wall panels. The corner portions are secured in overlapping pairs against the second pair of opposite side wall panels. Flap members are provided with each of the flap members being integral along a flap fold line with one of the side wall panels of the first pair of opposite side wall panels. Each of the flap members includes foldable portions constructed and arranged to be folded into generally overlapping relation with a central portion of the flap member. Closure members are provided with each of the closure members being integral along a closure fold line with one of the side wall panels of the second pair of opposite side wall panels. Tab structure secures a closure member to an adjacent flap member. Handle portions for carrying the carton are provided with each of the handle portions being integral along a handle fold line with one of the closure members. Each of the handle fold lines is generally parallel to a closure fold line and has an extent greater than the closure fold line. The carton is constructed and arranged such that it may be closed and may remain in a closed condition due to the construction of the carton itself.

20 Claims, 6 Drawing Sheets

CLOSABLE CARTON

This invention relates to carton-type containers and, more particularly, to cartons formed from single carton blanks and being capable of remaining in a closed position by the configuration of the carton itself.

BACKGROUND OF THE INVENTION

There are many situations where it is desirable to utilize a carton which can be easily closed for presentation to the user and easily opened by the user. A good example is consumable products such as take-out foods and the like. Generally, cartons of this type usually provide a storage portion and an integral cover for closing the open top of the storage portion after the food or product has been placed therein. The cover is typically retained in a closed position by a tying or locking arrangement, ensuring that the contents of the carton will be maintained in the storage portion. There is always a need to provide a carton having improved closing and opening structure which is cost effective and simple to assemble.

SUMMARY OF THE INVENTION

It is an object of the present invention to fulfill the need described above. In accordance with the principles of the present invention, this objective is accomplished by providing a carton erected from a single carton blank. The carton includes a bottom wall panel and four side wall panels, each of the side wall panels being integrally connected along a fold line to the bottom wall panel and folded upwardly therefrom, thereby defining first and second pairs of opposite side wall panels. The bottom wall panel and the four side wall panels define a container space. Corner portions integrally connect adjacent side wall panels, the corner portions being secured in overlapping pairs against the second pair of opposite side wall panels. Flap members are provided with each of the flap members being integral along a flap fold line with one of the side wall panels of the first pair of opposite side wall panels. Closure members are provided with each of the closure members being integral along a closure fold line with a respective side wall panel of the second pair of opposite side wall panels. Tab structure secures a closure member to an adjacent flap member. Handle portions are provided with each of the handle portions being integral along a handle fold line with a respective closure member. Each of the handle fold lines is generally parallel to a closure fold line and has an extent greater than the closure fold line. The handle portions and the closure members are generally co-planar with a respective side wall panel of the second pair of opposite side wall panels.

The carton is constructed and arranged such that to close the erected carton, the flap members are moved outwardly and downwardly about a respective flap fold line causing the handle portions to fold about their respective handle fold lines and come together in a position generally transverse with respect to the closure members, with each of the closure members being folded about a respective closure fold line so as to be disposed generally parallel to the bottom wall panel to close the container space. Each of the flap members is moved generally upwardly about a respective flap fold line causing the handle portions and the handle fold lines to be in generally abutting relation, respectively. The handle fold lines bow the first pair of opposite side wall panels outwardly, thereby maintaining the flap members in their upward position and maintaining the handle portions in their abutting relation which maintains the carton in a closed condition.

Another object of the present invention is the provision of a single, flat carton blank which can be simply erected and operable once erected to provide an easy closable and easy openable carton which is simple in construction and cost effective.

These and other objects of the present invention will become more apparent during the course of the following detailed and description and appended claims.

The invention may best be understood with reference to the accompanying drawings wherein an illustrative embodiment is shown.

DETAILED DESCRIPTION OF THE INVENTION

Figure 1:
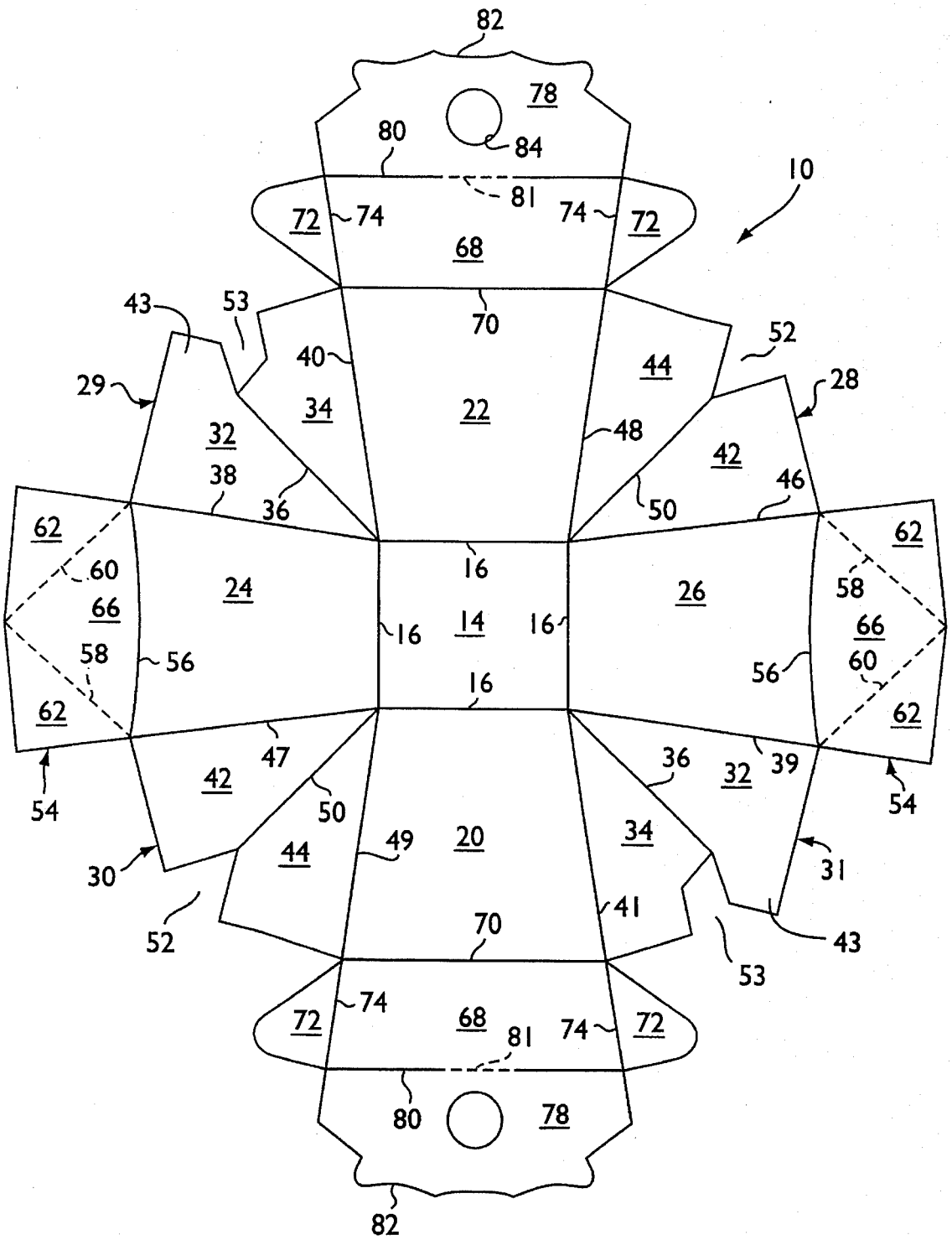
FIG. 1 is a top plan view of a single, flat blank capable of being erected into a carton embodying the principles of the present invention.

Referring now more particularly to the drawings, there is shown in FIG. 1 thereof a one-piece, flat blank of carton material, generally indicated at 10, embodying the principles of the present invention, which is operable to be erected and retained into an easy closed-easy open carton, generally indicated at 12, shown in FIGS. 3–9, which also embodies the principles of the present invention. The flat blank 10, as shown in FIG. 1, includes a bottom wall panel 14 which is defined peripherally by a plurality of fold lines 16. Four side wall panels are hinged to the bottom wall panel 14 along the fold lines 16 thereof including a front side wall panel 20, rearward side wall panel 22, a left side wall panel 24 and a right side wall panel 26. In the illustrated embodiment, the left and right side wall panels 24 and 26, define a first pair of opposite side wall panels while the front and rearward side wall panels 20 and 22 define a second pair of opposite side wall panels.

A plurality of corner portions, generally indicated at 28, 29, 30 and 31, integrally connect adjacent side wall panels. Corner portions 29 and 31 are identical and form opposing corners of the carton 12, when the carton is erected, as will become apparent below. Each of the corner portions 29 and 31 includes first and second corner members, 32 and 34, respectively, joined together at a central fold line 36. Corner member 32 of corner portion 29 is integral along a corner fold line 38 with the left side wall panel 24, while corner member 34 of corner portion 29 is integral along a corner fold line 40 with the rearward side wall panel 22. Similarly, corner member 32 of corner portion 31 is integral along a corner fold line 39 with the right side wall panel 26, while corner member 34 of corner portion 31 is integral along a corner fold line 41 with the front side wall panel 20. Each of the corner members 32 includes a tab 43, the function of which will become apparent below.

Corner portions 28 and 30 are likewise identical and form opposing corners when the carton is erected. Each of the corner portions 28 and 30 includes a first corner member 42 and a second corner member 44. Corner member 42 of corner portion 28 is integral along a corner fold line 46 with right side wall panel 26 while corner member 44 of corner portion 28 is integral along a corner fold line 48 with the rearward side wall panel 22. Similarly, corner member 42 of corner portion 30 is integral along a corner fold line 47 with the left side wall panel 24 while corner member 44 of corner portion 30 is integral along a corner fold line 49 with the front side wall panel 20. A central fold line 50 connects the corner members 42 and 44. Further, the members 42 and 44 cooperate to find a V-shaped notch 52 which facilitates folding of the corner members 28 and 30 upon erecting the carton, and reduces the length of the fold line 50 to permit an area of member 32 to bond to sidewalls 26 and 24.

A pair of identical flap members, generally indicated at 54, are provided with one flap member being integral along a generally curved flap fold line 56 with the left side wall panel 24 and the other flap member 54 being integral along curved flap fold line 56 with the right side wall panel 26, as shown in FIG. 1. Each of the flap members 54 includes score lines 58 and 60 defining foldable portions 62 which are foldable inwardly about the score lines 58 and 60 to be in a generally overlapping relation with a central portion 66 of the flap member 54, as will be explained in more detail below. In the illustrated embodiment, the score lines 58 and 60 are disposed in each of the flap members 54 so as to define three generally triangular members including a central triangular member and two minor triangular members adjacent opposite edges of the central triangular member. The central triangular member defines the central portion 66 of the flap member 54 and the minor triangular members define the foldable portions 62.

A pair of identical closure members 68 are provided with one closure member 68 being integral along a closure fold line 70 with the front side wall 20 and the other closure member 68 being integral along closure fold line 70 with the rearward side wall panel 22, as shown in FIG. 1.

Tab structure is provided for securing the closure members to adjacent flap members. In the illustrated embodiment, the tab structure includes a pair of opposing closure tabs 72 of generally triangular shape integral with each closure member 68 along a respective end or closure tab fold line 74. The closure tab fold lines 74 are generally transverse with respect to the closure fold lines 70. The closure tabs 72 are sized so that the entire surface area thereof may be engaged with an associated foldable portion 62 of the flap members 54 to secure the closure members to the flap members, as will be explained below. Although the tab structure is shown as a single closure tab, more than one closure tab may comprise the structure to secure each end of the closures members 68 to an adjacent flap member. Further, it can be appreciated that the tab structure may be integral with the flap members 54 instead of with the closure members 68, or with both of the flap members 54 and closure members 68.

Handle portions 78 are integral with each closure member 68 along a handle fold line 80. The handle fold line 80 is generally parallel to the closure fold line 70 and has an extent greater than the closure fold line 70, the function of which will become apparent below. Preferably, a portion 81 of each of the handle fold lines is scored which facilitates folding of the handle portions 78 upon erecting the carton 12. However, scored portion 81 is not required. Each handle portion 78 includes a bore 84 therethrough sized to receive a finger of a user for carrying the carton when the carton is in a closed position, with the bores 84 being aligned. In the illustrated embodiment, the bores 84 are sized to receive one finger. However, it can be appreciated that a variety of holding arrangements can be provided in the handle portions 78. For example, a bore or slot may be disposed through the handle portions 78 so as to cooperate with more than one finger of the user.

Figure 2:
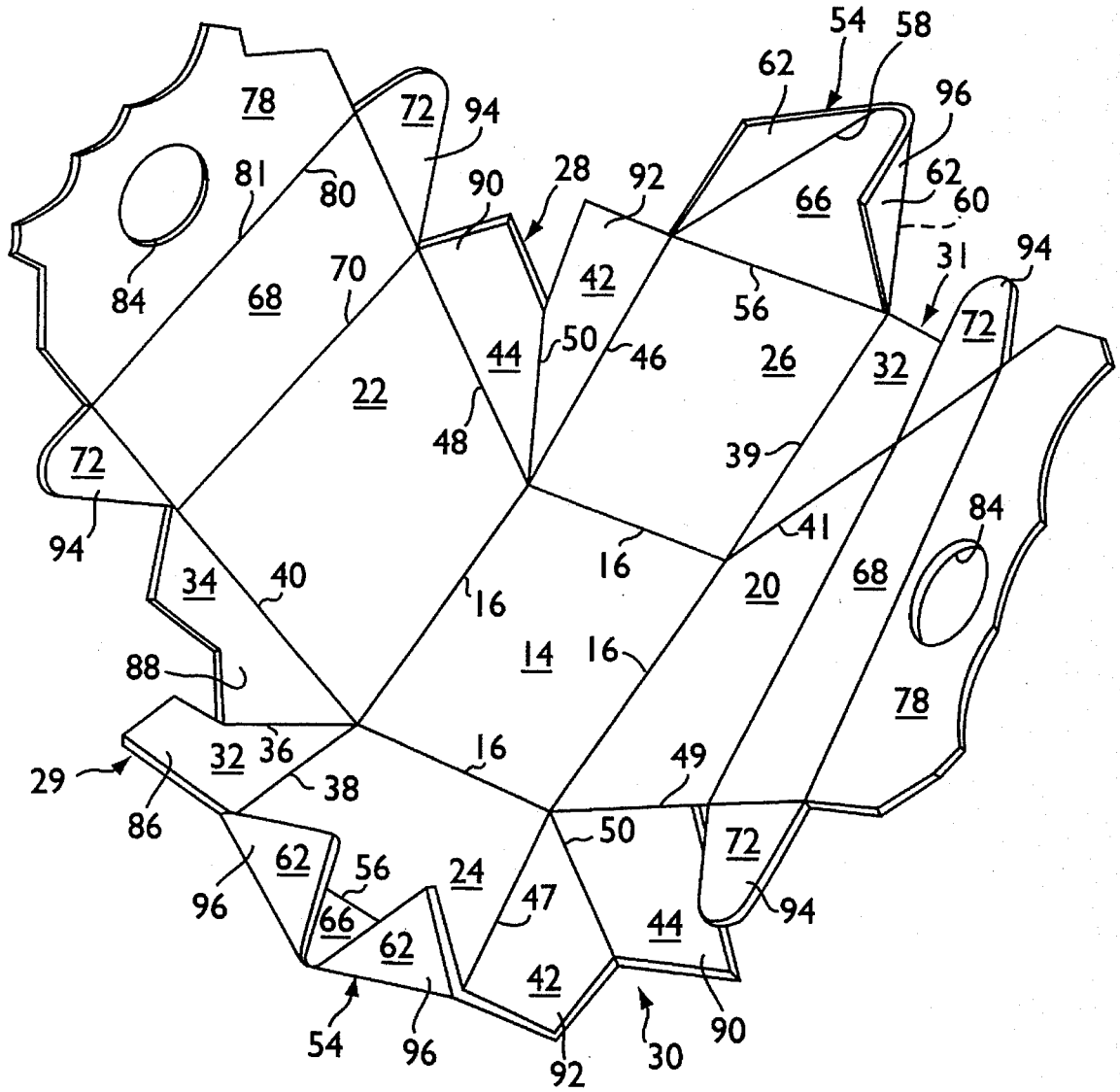
FIG. 2 is a perspective view of the flat blank of FIG. 1, shown being moved to its erected position.
Figure 8:
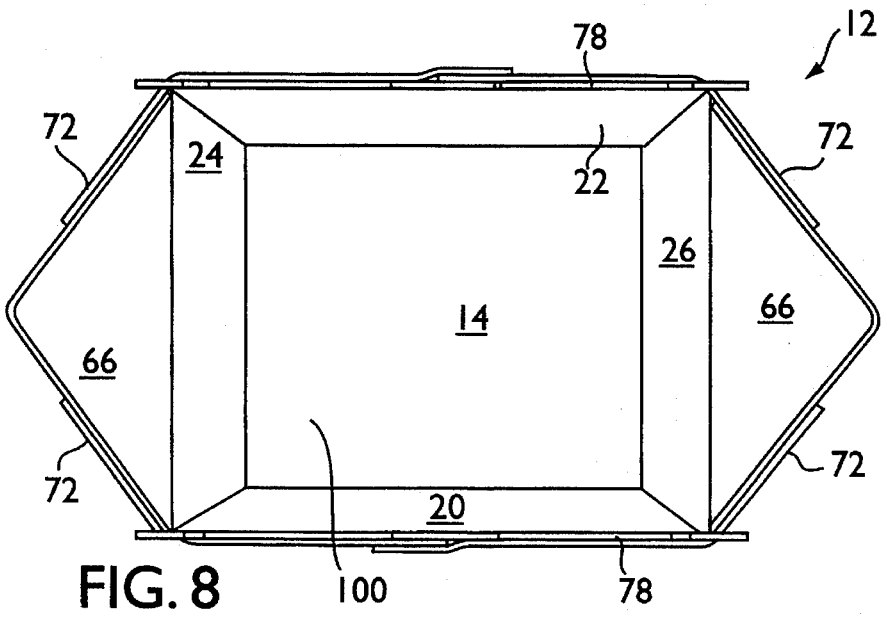
FIG. 8 is a plan view of the erected carton shown in an open position.

FIG. 2 illustrates the first steps in erecting a carton from the single, flat blank 10. It is noted that the steps to erect the carton are for example only and need not be performed in the order recited below. As shown, the front side wall panel 20, the rearward side wall panel 22, the left side wall panel 24 and right side wall panel 26 are folded upwardly from the bottom wall panel 14 about fold lines 16. The corner portions 28, 29, 30 and 31 are folded outwardly and are secured in overlapping pairs against the second pair of opposite side wall panels, 20 and 22. The bottom wall panel and four side wall panels of the erected carton define a container space 100, as shown in FIG. 8.

Figure 5:
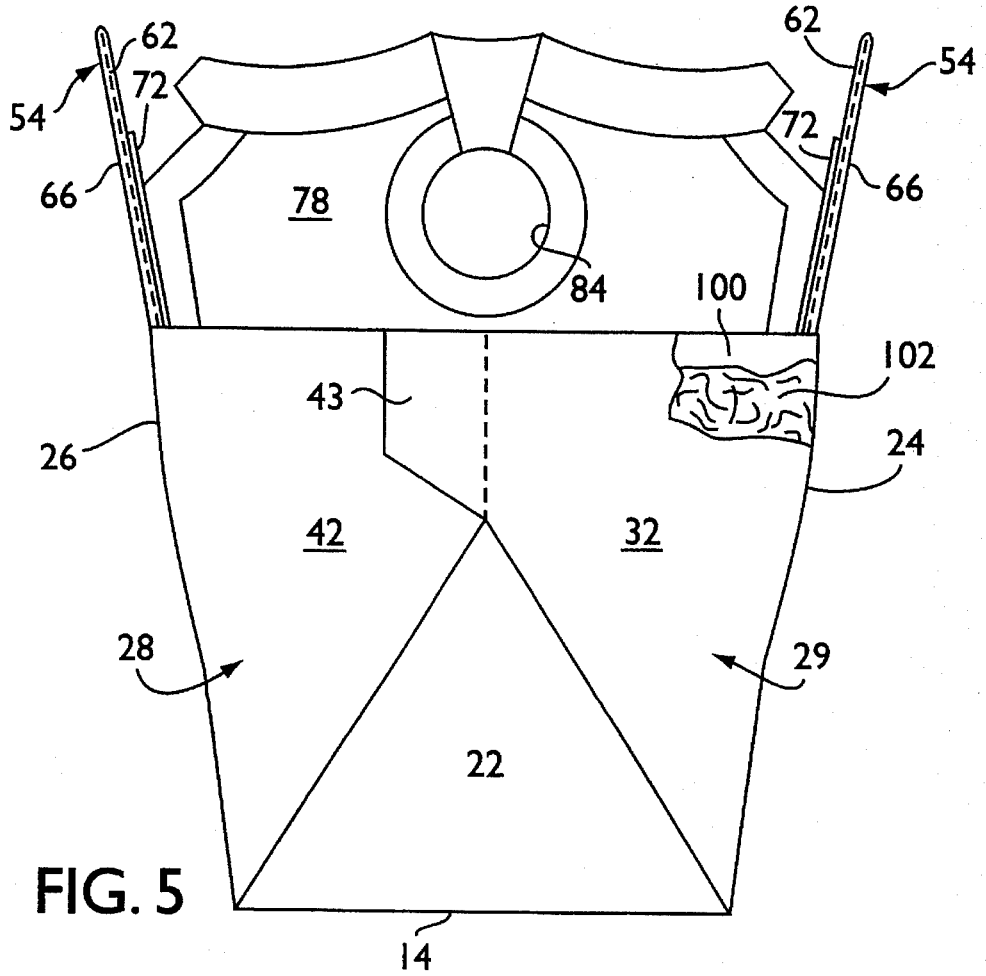
FIG. 5 is a rear elevational view of the erected carton shown in a closed position.

With reference to FIG. 2, in assembling corner portion 29, corner member 32 is folded about fold line 36 so as to overlap corner member 34 with surface 86 contacting surface 88, as the corner members 32 and 34 are folded about fold lines 38 and 40 such that the corner portion 29 contacts the outer surface of the rearward side wall panel 22. Corner portion 28 is likewise formed by folding corner member 42 and corner member 44 about fold line 50 outwardly such that surface 90 contacts surface 92. The corner members 42 and 44 are then folded about respective fold lines 46 and 48 and they are moved so as to overlap the outer surface of the rearward side wall panel 22. As shown in FIG. 5, tab 43 is overlapping a part of corner portion 28 with both corner portions 28 and 29 secured to the rearward side wall panel 22 by adhesive or the like. It can be appreciated that the corner portions 28 and 29 can be bonded to each other only with the tab 43, or they can be boned to the sidewall panel 22 in the notch area 53 (FIG. 1).

Figure 7:
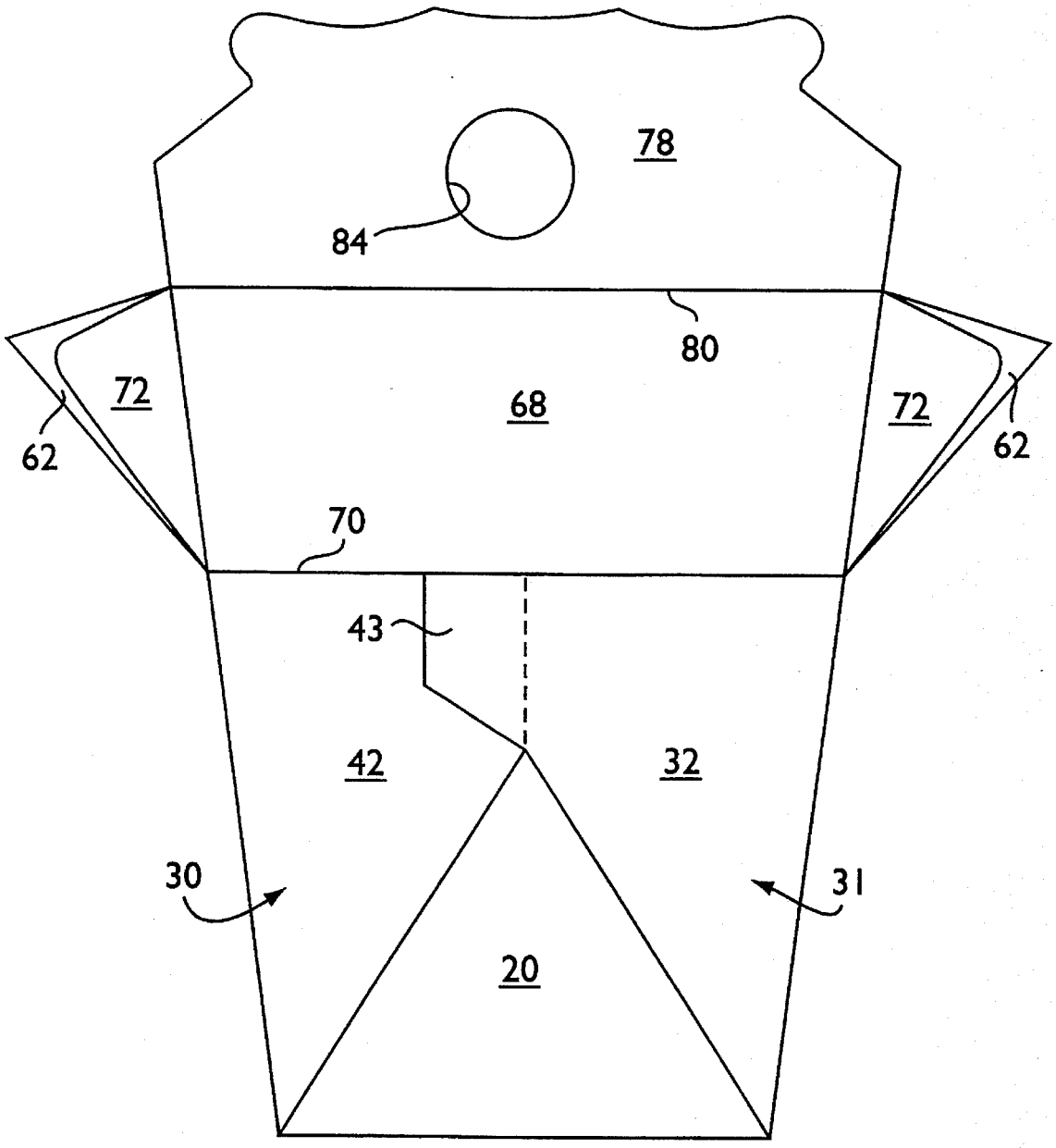
FIG. 7 is a front elevational view of the erected carton shown in an open position.

The corner portions 30 and 31 on the opposite side of the carton 12 are folded and affixed to the front side wall panel 20 in a similar manner, as shown in FIG. 7. Thus, the corner portions afford a construction which is liquid tight and which also reinforces the side wall panels 20 and 22.

Each of the closure tabs 72 is secured to an adjacent foldable portion 62 of the flap members 54 so as to be movable therewith, as best shown in FIG. 7. Thus, with reference to FIG. 2, surfaces 94 of the closure tabs 72 are engaged by adhesive or the like with surfaces 96 of the foldable portions 62 of the flap members 54. It can be appreciated that instead of securing the tabs 72 to the exterior surfaces 96 of the foldable portions, the tabs 72 can be secured to the underside of the foldable portions 62 so as to be disposed in an interior portion of the carton 12.

To close the erected carton, each of the flap members 54 is folded outwardly and downwardly about fold lines 56 with the foldable portions 62 being folded about score lines 58 and 60 so as to be disposed in generally overlapping relation with the central portion 66 of the associated flap member 54. This causes the handle portions 78 to fold about their respective handle fold lines 80 and the closure members 68 to fold about the closure fold lines 70. In this position, the handle portions 78 come together in a position generally transverse with respect to the closure members 68, with each of the closure members 68 being disposed generally parallel to the bottom wall panel 14 so as to close the container space 100.

Figure 6:
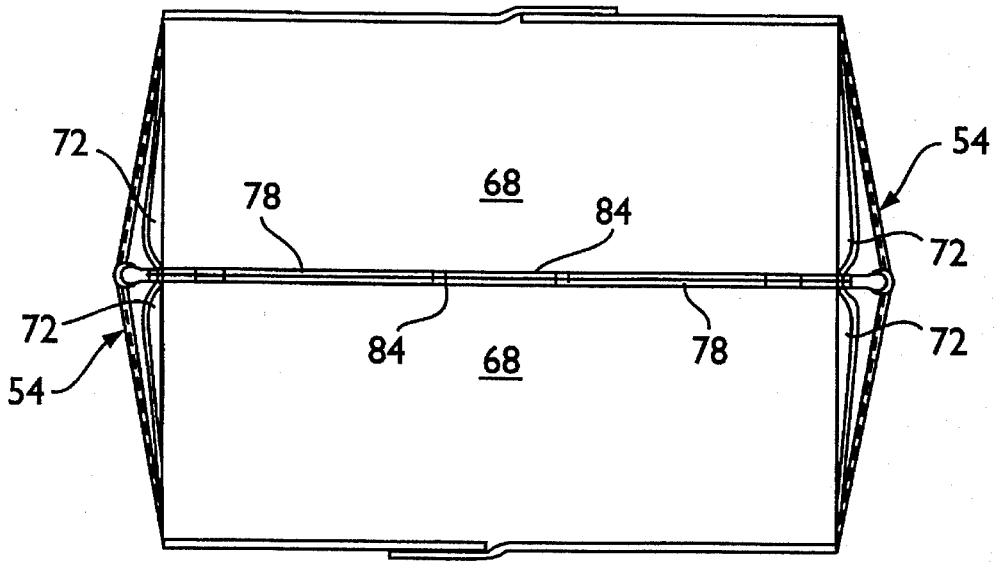
FIG. 6 is a plan view of the erected carton shown in its closed position.

Finally, each of the flap members 54 is folded generally upwardly about the curved flap fold line 56 causing the handle fold lines 80, which are in abutting relation, to bow the first pair of opposite side wall panels (panels 24 and 26) outwardly, as shown in FIG. 5 maintaining the handle portions 78 in generally abutting relation. The bowing of the side wall panels 24 and 26 is caused since the handle fold lines 80 are longer than the closure fold lines 70. The bowing action keeps the flap members 54 from relaxing back downwardly to their horizontal position (FIGS. 3 and 4) and thus prevents the handle portions 78 from moving away from their abutting positions, thereby preventing the carton 12 from opening. When the carton 12 is closed, as shown in FIGS. 5 and 6, the bores 84 of the abutting handle portions 78 align so as to define a carrying through-hole for receiving a finger of the consumer. Thus, it can be appreciated that the closing of the carton 12 is simple, with no tying arrangements or locking tabs to assemble. It can be appreciated that a convenient package may be presented to a consumer once a product 102 is placed in the container space 100 of the carton and the carton is closed, as shown in FIG. 5.

Figure 3:
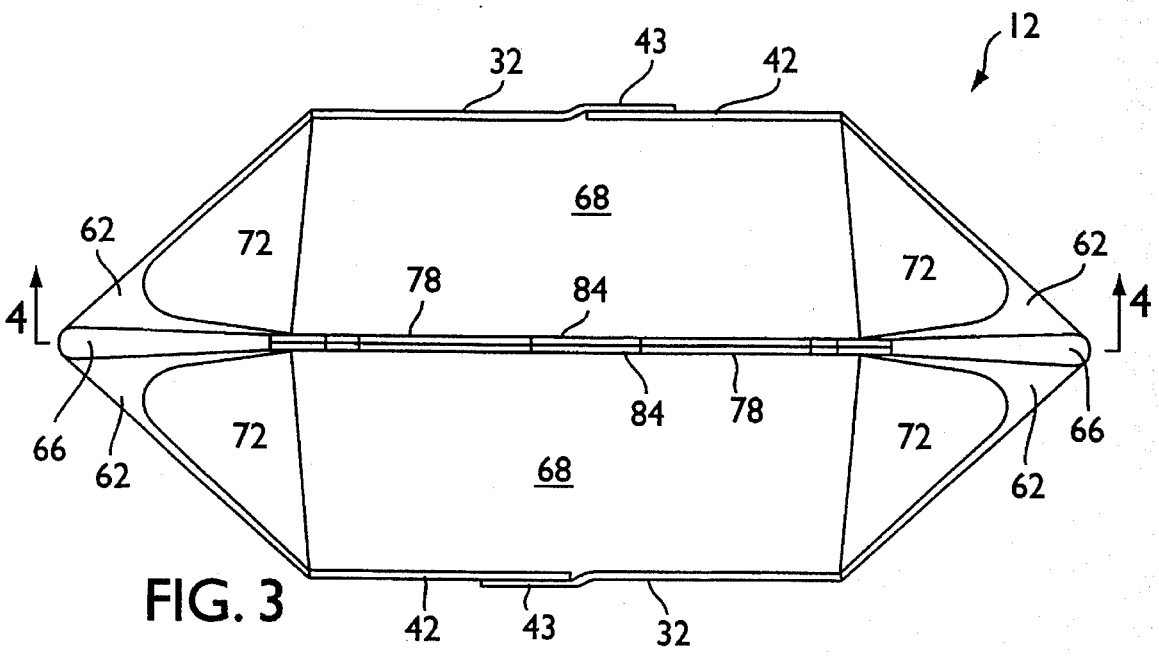
FIG. 3 is a plan view of the erected carton with the flap members thereof disposed in a generally horizontal position.
Figure 4:
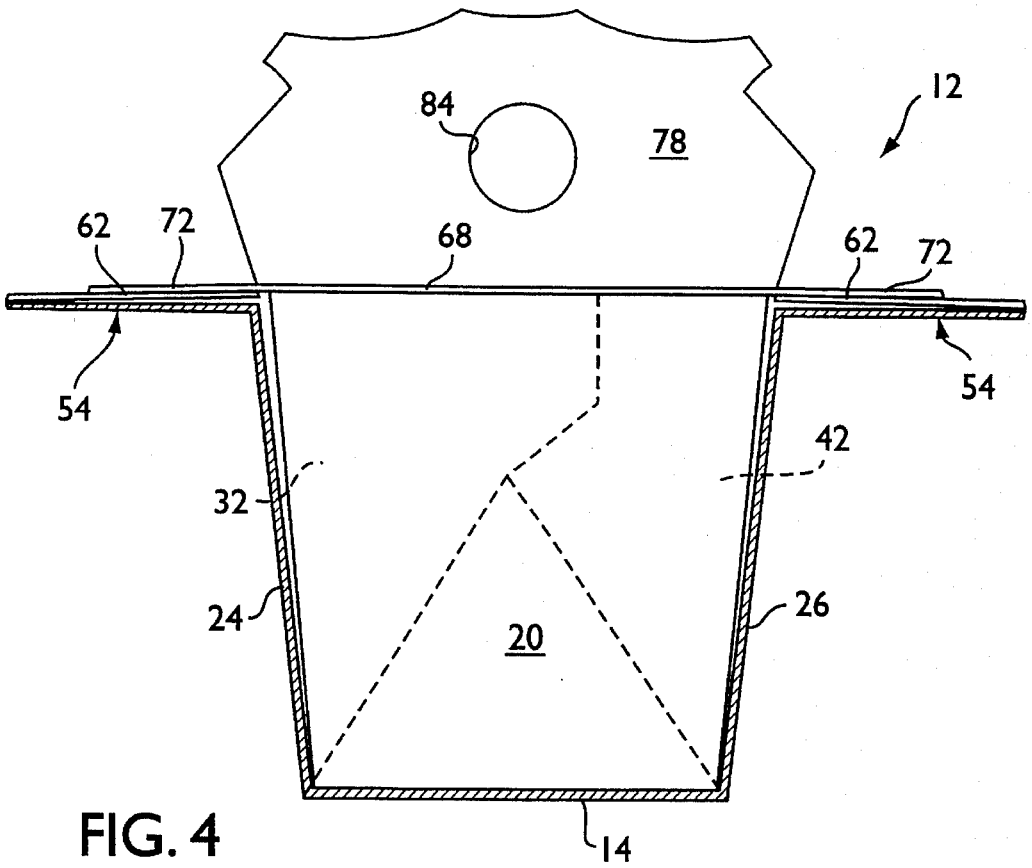
FIG. 4 is a cross-sectional view taken along the line 4—4 of FIG. 3.
Figure 9:
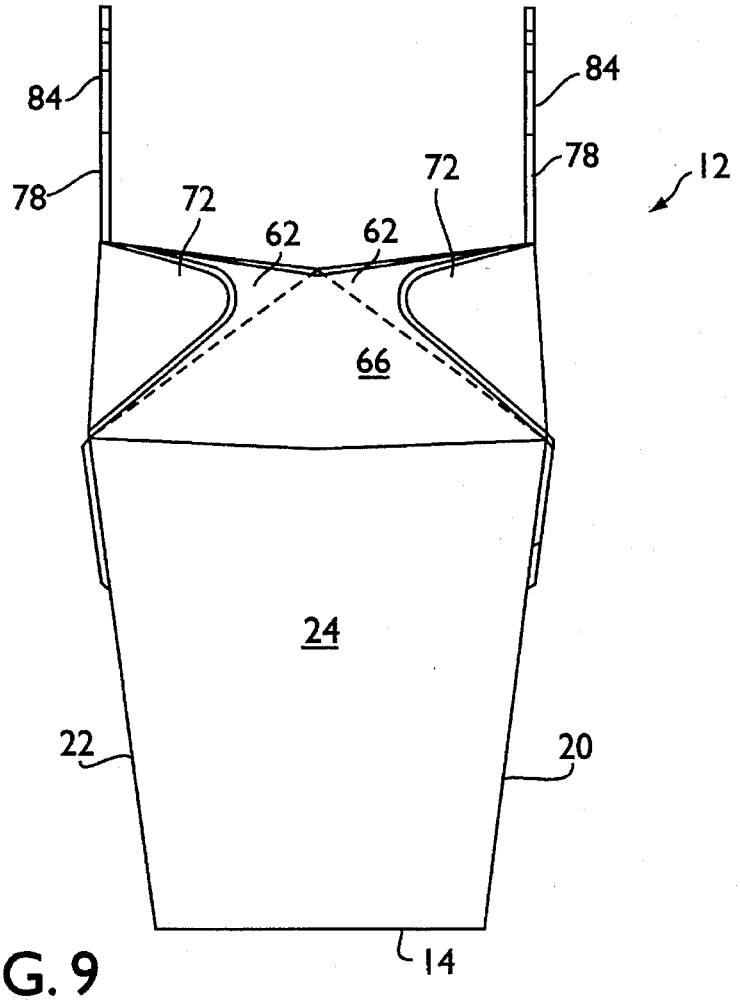
FIG. 9 is a left side elevational view of the erected carton shown in an open position.

To open the carton 12, the flap members 54 are simply moved from the generally vertical position (FIGS. 5 and 6) to their horizontal position (FIGS. 3 and 4). This movement relaxes the side wall panels 24 and 26 and the handles portions 78 may then be moved outwardly toward the side wall panels 20 and 22 to be in a position as shown in FIGS. 8 and 9 with the handle portions 78 and the closure members 68 being generally co-planar with the respective sidewall panel 20 and 22 of the second pair of opposite side wall panels. In the open position, the central portion 66 and the foldable portions 62 of the flap members 54 cooperate to define a pour spout for emptying the contents of the container space 100 of the carton 12.

The shape of the outer periphery 82 of the handle portion 78 is not critical; in the illustrated embodiment it is decoratively die-cut. The carton is of material which is microwaveable such as cardboard or the like having appropriate coatings.

Further, any conventional process may be employed to secure the corner portions to the side wall panels and the tabs to the flap members. For example, the blank 10 may be coated on each side with a polyethylene coating or the like. The corner portions may be secured to the side wall panels and the tabs to the flap members upon the application of heat and pressure when the carton is erected by conventional plunger techniques. Alternatively, hot-melt adhesives or cold adhesives can be used.

As best shown in FIG. 1, each of the sidewalls 20, 22, 24 and 26, closure members 68 and flap members 66 are tapered so that the full open configuration of the carton (FIG. 9) defines a generally inverted, truncated pyramidal configuration to enable stacked nesting of a plurality of cartons. It can be appreciated that the carton 12 may be placed in a nested and stacked relationship with a multiplicity of similar structures in a similar open position.

The carton 12 is particularly suited for use as a take-out food carton, but it can be appreciated that the carton may be used to contain other products. For example, the carton may be used to contain products that do not require a leak-proof carton. The carton may even be used as a gift container.

It thus will be seen that the objects of this invention have been fully and effectively accomplished. It will be realized, however, that the foregoing preferred specific embodiment has been shown and described for the purpose of illustrating the structural and functional principles of the present invention and is subject to change without departure from such principles. Therefore, this invention includes all modifications encompassed within the spirit and scope of the following claims.

What is claimed is:

1. A carton erected from a single carton blank and disposed in a closed condition, said carton comprising:

a bottom wall panel, four side wall panels, each of said side wall panels being integrally connected along a fold line to said bottom wall panel and disposed upwardly therefrom thereby defining first and second pairs of opposite side wall panels, said bottom wall panel and said four side wall panels defining a container space, corner portions integrally connecting adjacent side wall panels, said corner portions being secured in overlapping pairs against said second pair of opposite side wall panels, flap members, each of said flap members being integral along a flap fold line with one of said side wall panels of said first pair of opposite side wall panels, each of said flap members defining foldable portions folded into generally overlapping relation with a central portion of said flap member, closure members, each of said closure members being integral along a closure fold line with a respective side wall panel of said second pair of opposite side wall panels, tab structure securing a closure member to an adjacent flap member, and handle portions, each of said handle portions being integral along a handle fold line with a respective said closure member, each of said handle fold lines being generally parallel to a closure fold line and having an extent greater than said closure fold line, said flap members extending upwardly from said first pair of opposite side wall panels with each of said closure members being disposed generally parallel to said bottom wall panel so as to close the container space, said handle portions being disposed between said flap members in generally abutting relation and being generally transverse with respect to said closure members, said handle fold lines being in generally abutting relation and causing said first pair of opposite side wall panels to bow outwardly to maintain the flap members in their upward position thereby maintaining the handle portions in their abutting relation.

2. The carton according to claim 1, wherein each of said flap fold lines is generally curved.

3. The carton according to claim 1, wherein said tab structure includes a pair of opposing closure tabs integral with each of said closure members along respective closure tab fold lines, said closure tab fold lines being generally transverse with respect to said closure fold lines.

4. The carton according to claim 1, wherein each of said handle portions has a bore therethrough such that when said handle portions are in said abutting relation, said bores are aligned to define a through-hole for receiving at least one user finger to carry the carton.

5. The carton according to claim 3, wherein two score lines are disposed in each of said flap members so as to define three generally triangular members including a central triangular member and two minor triangular members adjacent opposite edges of said central triangular member, said central triangular member defining said central portion of said flap member and said minor triangular members defining said foldable portions.

6. The carton according to claim 5, wherein each of said closure tabs is generally triangular and sized so that an entire surface area thereof engages an associated minor triangular member.

7. A carton erected from a single carton blank to be in an opened condition, said carton comprising:

a bottom wall panel, four side wall panels, each of said side wall panels being integrally connected along a fold line to said bottom wall panel and folded upwardly therefrom, thereby defining first and second pairs of opposite side wall panels, said bottom wall panel and said four side wall panels defining a container space, corner portions integrally connecting adjacent side wall panels, said corner portions being folded outwardly and secured in overlapping pairs against said second pair of opposite side wall panels, flap members, each of said flap members being integral along a flap fold line with one of said side wall panels of said first pair of opposite side wall panels, closure members, each of said closure members being integral along a closure fold line with a respective side wall panel of said second pair of opposite side wall panels, tab structure securing a closure member to an adjacent flap member, and handle portions, each of said handle portions being integral along a handle fold line with a respective said closure member, each of said handle fold lines being generally parallel to a closure fold line and having an extent greater than said closure fold line, said handle portions and said closure members being generally co-planar with a respective side wall panel of said second pair of opposite side wall panels.

8. The carton according to claim 7, wherein each of said flap members includes score lines defining foldable portions constructed and arranged to be folded into generally overlapping relation with a central portion of said flap member.

9. The carton according to claim 8, wherein said flap members, closure members and handle portions are constructed and arranged such that to close the carton, said flap members are moved outwardly and downwardly about a respective flap fold line with said foldable portions being disposed in generally overlapping relation with said central portion thereof, causing said handle portions to fold about their respective handle fold lines and come together in a position generally transverse with respect to said closure members, with each of said closure members being folded about a respective closure fold line so as to be disposed generally parallel to said bottom wall panel to close the container space, and each of said flap members being moved generally upwardly about a respective flap fold line causing said handle portions and said handle fold lines to be in generally abutting relation, respectively, said handle fold lines bowing said first pair of opposite side wall panels outwardly, thereby maintaining the flap members in their upward position and maintaining the handle portions in their abutting relation.

10. The carton according to claim 8, wherein said tab structure includes a pair of opposing closure tabs integral with each of said closure members along respective closure tab fold lines, said closure tab fold lines being generally transverse with respect to said closure fold lines.

11. The carton according to claim 10, wherein two score lines are disposed in each of said flap members so as to define three generally triangular members including a central triangular member and two minor triangular members adjacent opposite edges of said central triangular member, said central triangular member defining said central portion of said flap member and said minor triangular members defining said foldable portions.

12. The carton according to claim 10, wherein each of said closure tabs is generally triangular and sized so that an entire surface area thereof engages an associated minor triangular member.

13. The carton according to claim 7, wherein each of said side wall panels, closure members and flap members are tapered such that in the opened condition, the carton defines a generally inverted, truncated pyramidal configuration to enable stacked nesting of a plurality of cartons.

14. A flat blank of carton material cut and scored to be erected into a carton, said flat blank comprising:

a bottom wall panel, four side wall panels, each of said side wall panels being integrally connected along a fold line to said bottom wall panel thereby defining first and second pairs of opposite side wall panels, corner portions integrally connecting adjacent side wall panels, said corner portions being constructed and arranged to be folded outwardly and secured in overlapping pairs against said second pair of opposite side wall panels, flap members, each of said flap members being integral along a flap fold line with one of said side wall panels of said first pair of opposite side wall panels, each of said flap members defining foldable portions constructed and arranged to be folded into generally overlapping relation with a central portion of said flap member, closure members, each of said closure members being integral along a closure fold line with one of said side wall panels of said second pair of opposite side wall panels, tab structure constructed and arranged to permit a closure member to be secured to an adjacent flap member, and handle portions, each of said handle portions being integral along a handle fold line with one of said closure members, said handle fold line being generally parallel to said closure fold line and having an extent greater than said closure fold line.

15. The flat blank according to claim 14, wherein each of said flap fold lines is generally curved.

16. The flat blank according to claim 14, wherein said tab structure includes a pair of opposing closure tabs integral with each of said closure members along respective closure tab fold lines, said closure tab fold lines being generally transverse with respect to said closure fold lines.

17. The flat blank according to claim 16, wherein two score lines are disposed in each of said flap members so as to define three generally triangular members including a central triangular member and two minor triangular members adjacent opposite edges of said central triangular member, said central triangular member defining said central portion of said flap member and said minor triangular members defining said foldable portions.

18. The flat blank according to claim 17, wherein each of said closure tabs is generally triangular and sized so that an entire surface area thereof may engage an associated minor triangular member.

19. A method of closing an erected carton, said carton including a bottom wall panel; four side wall panels, each of said side wall panels being integrally connected along a fold line to said bottom wall panel thereby defining first and second pairs of opposite side wall panels, said bottom wall panel and said four side wall panels defining a container space; corner portions integrally connecting adjacent side wall panels, said corner portions being secured in overlapping pairs against said second pair of opposite side wall panels; flap members, each of said flap members being integral along a flap fold line with one of said side wall panels of said first pair of opposite side wall panels, each of said flap members defining foldable portions; closure members, each of said closure members being integral along a closure fold line with one of said side wall panels of said second pair of opposite side wall panels; tab structure securing a closure member to an adjacent flap member; and handle portions, each of said handle portions being integral along a handle fold line with one of said closure members, each of said handle fold lines being generally parallel to a closure fold line and having an extent greater than said closure fold line, the method including:

moving each of said flap members outwardly and downwardly about a respective flap fold line with said foldable portions being disposed in generally overlapping relation with said central portion thereof, causing said handle portions to fold about their respective handle fold lines and come together in a position generally transverse with respect to said closure members, with each of said closure members being folded about the closure fold line so as to be disposed generally parallel to said bottom wall panel closing said container; and moving each of said flap members generally upwardly about a respective flap fold line causing said handle portions and said handle fold lines to be in generally abutting relation, respectively, said handle fold lines causing said bowing said first pair of opposite side wall panels outwardly, thereby maintaining the flap members in their upward position so as to maintain the handle portion in their abutting relation and thus the carton in a closed position.

20. A package comprising:

a carton of flat carton material comprising:

a bottom wall panel, four side wall panels, each of said side wall panels being integrally connected along a fold line to said bottom wall panel and disposed upwardly therefrom thereby defining first and second pairs of opposite side wall panels, said bottom wall panel and said four side wall panels defining a container space, corner portions integrally connecting adjacent side wall panels, said corner portions being secured in overlapping pairs against said second pair of opposite side wall panels, flap members, each of said flap members being integral along a flap fold line with one of said side wall panels of said first pair of opposite side wall panels, each of said flap members defining foldable portions folded into generally overlapping relation with a central portion of said flap member, closure members, each of said closure members being integral along a closure fold line with one of said side wall panels of said second pair of opposite side wall panels, tab structure securing a closure member to an adjacent flap member, and handle portions, each of said handle portions being integral along a handle fold line with one of said closure members, each of said handle fold lines being generally parallel to a closure fold line and having an extent greater than said closure fold line, said flap members extending upwardly from said first pair of opposite side wall panels with each of said closure members being disposed generally parallel to said bottom wall panel so as to close the container space, said handle portions being disposed between said flap members in generally abutting relation and being generally transverse with respect to said closure members, said handle fold lines being in generally abutting relation and causing said first pair of opposite side wall panels to bow outwardly to maintain the flap members in their upward position thereby maintaining the handle portions in their abutting relation, and a product disposed within said container space.

* * * * *